US005149583A

United States Patent [19]

Saarikettu

[11] Patent Number: 5,149,583

[45] Date of Patent: Sep. 22, 1992

[54] ORIENTED THREAD STRUCTURE AND A METHOD FOR MANUFACTURING SAME

[76] Inventor: Jukka Saarikettu, Kustaa Adolfinkatu 78, SF-67200 Kokkola, Finland

[21] Appl. No.: 548,982

[22] PCT Filed: Feb. 9, 1989

[86] PCT No.: PCT/FI89/00020

§ 371 Date: Jul. 31, 1990

§ 102(e) Date: Jul. 31, 1990

[87] PCT Pub. No.: WO89/07673

PCT Pub. Date: Aug. 24, 1989

[30] Foreign Application Priority Data

Feb. 9, 1988 [FI] Finland ..... 880571

[51] Int. Cl.[5] ..... B32B 7/00

[52] U.S. Cl. ..... 428/253; 66/190; 66/202; 428/114; 428/229; 428/232; 428/293; 428/294; 428/902

[58] Field of Search ..... 428/293, 294, 253, 902, 428/114, 229, 232; 66/190, 202

[56] References Cited

U.S. PATENT DOCUMENTS 3,819,461 6/1974 Saffadi ..... 428/112

4,948,658 8/1990 Halker ..... 428/253

*Primary Examiner*—James J. Bell

*Attorney, Agent, or Firm*—Brooks & Kushman

[57] ABSTRACT

A method for the manufacture of an oriented thread structure for lamination and/or protective purposes is disclosed in which preferably glass, carbon, aramide, borax or ceramic reinforcing threads (1), in general are bound to form an oriented thread mat. The mat can be laminated inside a resin or other binder to form a strong shell structure, in which the strength of the shell is principally based on the strength of the above-mentioned reinforcing threads (1). The laminable thread structure can be easily formed on the surface of a mold and avoids air-bubbles in the laminate. The reinforcing threads (1) are bound to a basic knitted structure consisting of one-sided loops (2) by loops (3, 4) running transversely in the opposite direction.

12 Claims, 2 Drawing Sheets

ORIENTED THREAD STRUCTURE AND A METHOD FOR MANUFACTURING SAME

TECHNICAL FIELD

The present invention relates to an oriented thread structure to be laminated into a fiber-resin composite and a method for manufacturing the oriented thread structure.

BACKGROUND ART

In accordance with known technology, a glass-fiber composite is manufactured by spreading resin on a glass-fiber mat that has been placed on top of or inside a mold. The glass-fiber can be bound into a glass-fiber mat as discontinuous fibers, or woven into a blanket structure. The problem with these is that air-bubbles tend to remain in the laminate. This phenomenon is especially problematic at corners. One blanket structure is known from the German patent application publication DE 3.304.345. U.S. Pat. No. 3,201,104 shows a circular knitting machine, in which metal wire, intended to reinforce a hose, is bound into knitted fabric. In this, however, the fabric is a fairly loose net. If the fabric is drawn tight, the reinforcing wire or thread will not remain straight, rendering it unsuitable for glass-fiber, for instance, which loses its strength when bent.

DISCLOSURE OF THE INVENTION

An object of the present invention is to create a new type of oriented thread structure which can be easily formed to the surface of a mold, and which avoids the aforementioned air bubbles in a laminate.

Another object of the invention is to use the so-called prepreg or commingled method in which a binder is contained in the support loop threads or fed next to it so that when it is heated it hardens into a knitting of a thin shell structure. Therein it is possible to use polyester thread as one kind of binder. When the support loop threads are of an elastic material, the knitted threads draw together so that the inelastic reinforcing threads project from the fabric. These projections are controlled by leaving openings from which the reinforcing thread is made to project at regular intervals in the knitted fabric. Further advantages of the invention are listed as follows:

- achieving a very low specific weight by means of a suitable choice of support loop thread filament and reinforcing thread filament materials;
- achieving an excellent moisture absorption ability in which case there is little formation of air bubbles in the laminate by means of a suitable choice of support loop thread filament (e.g. polyester);
- achieving a high strength by placing the oriented glass-fiber filaments in such a way that they carry most of the load that the laminate is intended to withstand;
- providing a knitted fabric containing the reinforcing threads that are elastic or flexible in every direction, so that it is easy to laminate and to form it on a mold corresponding to its use;
- providing a hose-like knitted element that can easily be cut both across and with the direction of the oriented threads, which makes it possible to use the knitted element as a sheet element of a desired shape and/or size.

It is also intended to create a support loop thread structure that can be used for various protective purposes. In addition, the invention is intended to create a method of manufacturing the thread structure that can be used for any thread at all that is required to be oriented.

The main principle of the invention is the binding of the reinforcing threads to a double-sided knitted fabric, in a transverse direction to the wales. The method makes it possible to achieve a great output in production. A tube-like thread structure is particularly advantageous as, during lamination, it can be drawn directly onto a pipe, pin, or corresponding form. Generally, both support loop thread and reinforcing threads are filament threads, i.e. endless threads.

The method is used to create dense knitting with reinforcing threads. The form of application has the particular advantage that when resin is effectively sucked into the fabric, it is unlikely that air-bubbles will form. Many reinforcing threads do not withstand knots at all. The strength of aramide threads, on the other hand, is retained even after they have been bent to a reasonable extent, in which case the entire thread structure can be knitted with this thread. Similar experiments are also being made with spun glass-thread.

In place of only a single reinforcing thread, it is naturally possible to use several reinforcing threads, i.e. bunches of threads. On the other hand, it is not necessary to feed reinforcing threads to every course of loops. In this connection, there is no problem in using as the reinforcing thread any known thread, for example glass, carbon, aramide, borax, and ceramic thread, either as filaments or as bunches of filaments. It is also possible to use polyamides and their derivatives as reinforcing threads.

In what follows the objects and advantages of the invention are illustrated by means of examples in the following detailed description by referring to the accompanying drawing Figures.

BEST MODE FOR CARRYING OUT THE INVENTION

Figure 1:
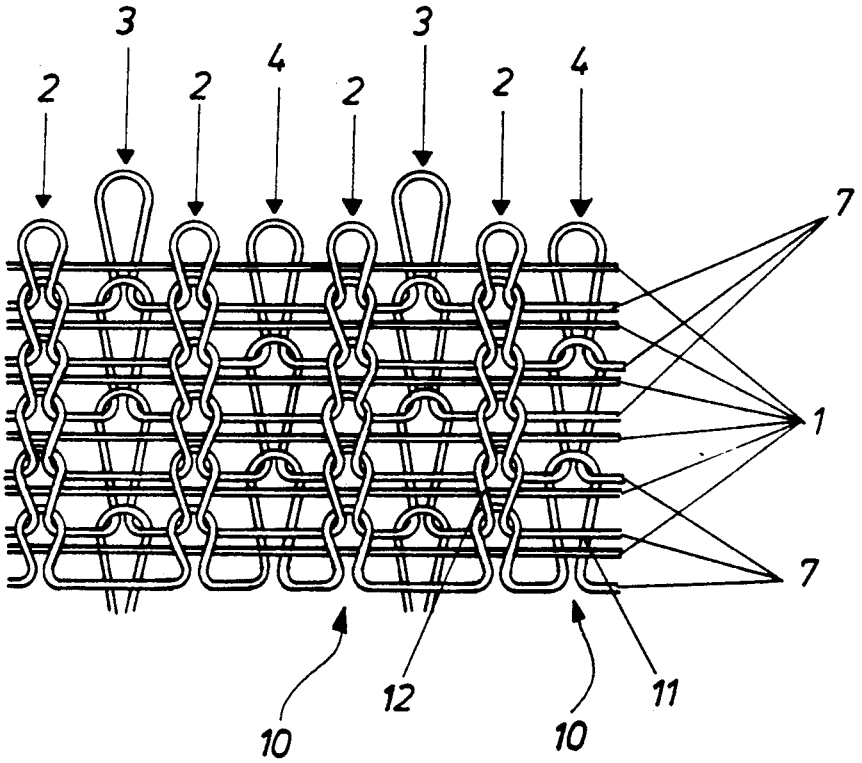
FIG. 1 shows an enlarged picture of the knitted fabric in accordance with the invention.

The knitted fabric shown in FIG. 1 is created with a so-called double circular knitting machine, in which there are vertical cylinder needles and horizontal plate needles. Generally it is possible to speak of the first set of needles and the second set of needles, the first of which knits the right way round and the second knits the wrong way round. Polyester or other thread is used as the base support loop thread 7 i.e. as the loop filament. The needles on the cylinder side are set to knit on every feed, i.e. the loops 2 in the course. The needles on the plate side, on the other hand, are set to knit in the so-called interlock setting, in which case in the consecutive feeding knitting takes place reciprocally. The loops knitted by the plate needles are marked with the reference numbers 3 and 4. The reinforcing thread 1 is fed to every second course and it remains in the channels formed by loops 2, 3, 4 in different directions. The reinforcing threads 1 remain transverse to the direction of the wales 10. Because of the interlock setting, the knitted fabric tends to contract longitudinally, in which case the reinforcing threads become very dense. The possible projection of the reinforcing threads is controlled by removing needles from the set of plate needles at regular intervals, so that the reinforcing thread projects from the gaps that arise. Surprising advantages in lamination are gained with this kind of knitted fabric. Because of the projecting loops of reinforcing threads, the direction of the threads is tri-axial, which prevents the delamination of the finished reinforcing structure, in other words, the separation of its layers from each other.

Naturally it is possible for the support loop thread structure to deviate from the above in many ways. The knitted fabric must have, however, loops that are formed in both directions, both "right-way round" and "wrong-way round", so that the reinforcing thread can be led between them. Reinforcing threads can also be knitted into a very loose smooth knitted fabric. The diameters of the cylinders of knitting machines in general use range from ⅝" to 36". By using a larger machine it is possible to efficiently manufacture wide thread mats, as the hose can be cut open and spread out as a mat. For example,, a 36" machine can make thread cloth about 2.8 meters wide. During lamination alternating layers can be placed cross-wise, so that the strength of the laminate is equally great in all directions. On the other hand, it is very easy to achieve the lamination of hose-like products with a hose-like thread structure. A spiral direction for the reinforcing thread is exactly right when considering, for example, pressure loading.

Figure 2:
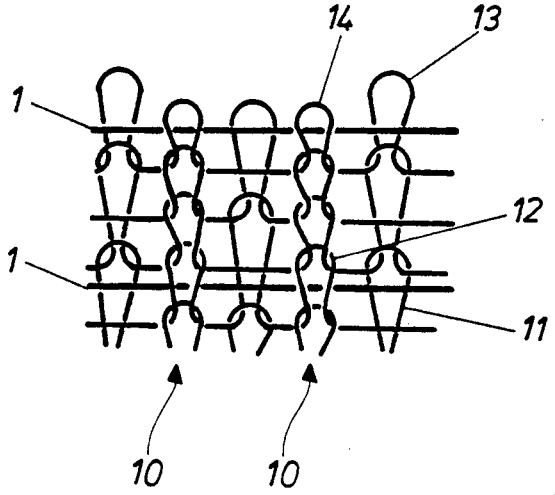
FIG. 2 shows an enlargement of another knitted fabric.

In a second embodiment of the invention the oriented reinforcing threads 1 run in the way shown in FIG. 2 above and below the loops 13 and 14 of the support loop threads in a straight direction and parallel to one another in the channel formed between the courses 11 and 12 every third course, this being perpendicular to the wales 10 in such a way that each right-way round loop 14 of the courses 11 and 12 that contain the support threads 2 enclose beneath them on reinforcing thread 1. In order to achieve this kind of support loop thread filament arrangement an amount of support loop thread filaments corresponding to the course number ¼ is used in a circular knitting machine. The filaments are led to the needle ring from feeding points located peripherically at regular intervals. A quantity of loop threads filaments corresponding to ¾ are led from the feeding points situated at regular intervals on the needle ring. When the course number is the above-mentioned 36, there are 9 support loop thread filaments and 27 loop thread filaments. In the knitted element then produced, a number of the first and second courses 11 and 12 are knitted together without the support loop thread 1 being dropped between them. In the direction of the wales 10, each course 11, 12 containing support loop thread 1 is followed by at least one course without a support loop thread filament.

Figure 3:
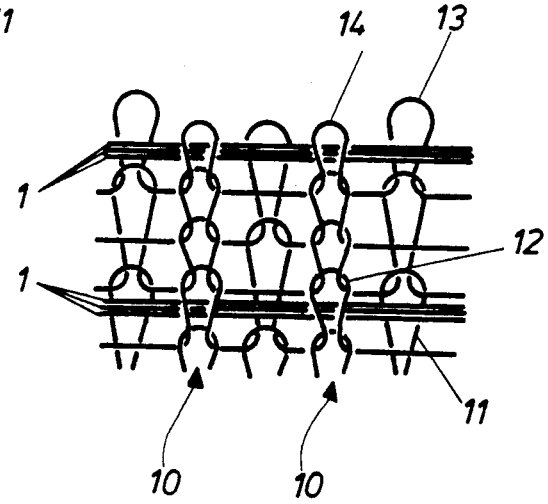
FIG. 3 shows an enlargement of a third kind of knitted fabric.

FIG. 3 shows still one more adavantageous knitted element already touched on in the previous form of application, which is formed according to the second embodiment of the invention, with the difference that in place of one support loop thread 1, several, in this case three, parallel support loop thread filaments are laid from one feeding point at a time on top of the first course 11. Thus in this case each course 11, 12 containing several parallel support loop threads 1 are followed, in the direction of the wales 10, by two support loop thread courses that have no support loop thread filaments. In a corresponding manner, binder threads can be laid together with the reinforcing thread.

Figure 4:
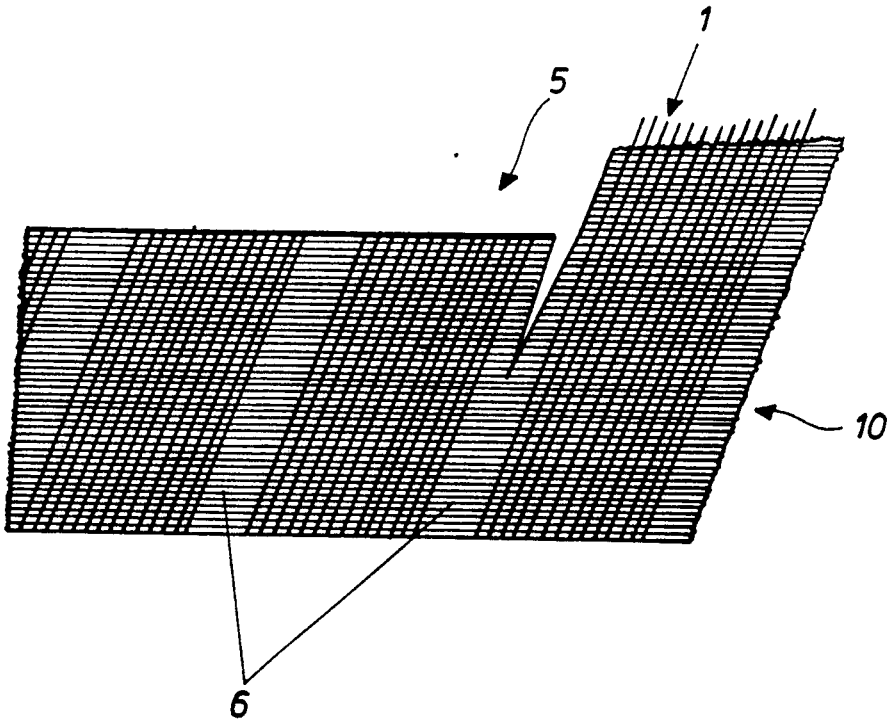
FIG. 4 shows a hose-like knitted fabric.

FIG. 4 shows a hose-like knitted fabric 5, from which a ribbon-like thread structure is obtained. The hose-like fabric 5 is divided into narrow strips 6, to which no reinforcing thread is fed. The knitted fabric can easily be cut open at the edge of the strip 8 and thus the above-mentioned ribbon-like product can be obtained. FIG. 4 shows clearly that the wales 10 run perpendicularly in the hose-like fabric, whereas the reinforcing threads 1 run round the fabric in a spiral.

In one test, a knitted fabric having a ratio of glass-thread to polyester filaments of about 50/50 was laminated producing a low specific weight of 1.3 g/cm$^3$ for the laminate. The theoretical density of a hollow sphere with a diameter of 100 mm and a wall thickness of 2.5 mm would be about 0.2 g/cm$^3$ with this laminate.

A method making the knitted fabric elastic also in the direction of the reinforcing threads includes first treating the thread so that when at rest it assumes a spiral or twisted form. Then in the finished product the thread tends to contract, making the resulting fabric laminable with aramide resins.

While the best mode for carrying out the invention has been described in detail, those familiar with the art to which this invention relates will recognize various alternative designs and embodiments for practicing the invention as defined by the following claims.

What is claimed is:

1. A method for the manufacture of an oriented thread structure to be laminated, in which reinforcing threads (1) are bound to form an oriented fiber mat or corresponding knitted element, by which the threads (1) are laminated inside resin or other binder and thus a strong shell structure is formed, characterized in that the knitting is carried out on a so-called double circular knitting machine to form a weft-knitted mat in such a way that the knitting includes the following sequential and continually repeating stages in manufacture.

(a) making a first loop (2) by a first set of needles, (b) orienting at least one reinforcing thread (1) to be included in the knitted fabric on top of the above-mentioned first loop, and (c) putting a second loop (3,4) by a second set of needles on top of the oriented reinforcing thread and attached to the above-mentioned first loop, in which case the oriented reinforcing thread (1) runs with the support of the loops (2,3,4) and straight between the courses in the channel formed by them.

2. A method of manufacture in accordance with claim 1, characterized in that the needles on the cylinder side are essentially arranged to knit in each feed and the dial or corresponding needles are arranged to reciprocally by-pass, i.e. they are set to the so-called interlock position, so that the knitted fabric is made to contract longitudinally.

3. A method of manufacture in accordance with claim 1, characterized in that the support loop thread (7) is polyester or other thread that absorbs resin.

4. A method of manufacture in accordance with claim 1, characterized in that more than one reinforcing thread (1) is laid in parallel on top of the first loop (2).

5. A method of manufacture in accordance with claim 1, characterized in that a part of the courses of the first and second loops (2,3,4) are knitted together without the above-mentioned reinforcing thread filament being laid between them.

6. A method of manufacture in accordance with claim 1, characterized in that aramide or spun glass-thread is used as the support loop thread (7).

7. A method of manufacture in accordance with claim 1, characterized in that the reinforcing thread contains binder for lamination, which is made to react by the application of heat or in some other manner, and which then makes it possible to manufacture a strong shell structure by means of the prepreg method.

8. A method of manufacture in accordance with claim 1, characterized in that one needle has been removed at regular intervals from one side, most advantageously from the dial needles' side, in which case the reinforcing thread is made to project from the opening thus created in the knitted fabric.

9. A thread structure to be laminated, in which reinforcing threads (1) are bound to form an oriented weft-knitted thread mat or corresponding knitted element, by means of which the threads (1) are laminated inside resin or other binder and thus form a strong shell structure, characterized in that the reinforcing thread (1) in the transverse direction is bound to the smooth weft-knitted fabric formed by the right-side loops (2) by means of the wrong-side loops (3,4).

10. A knitted thread structure in accordance with claim 9, characterized in that the knitted fabric (5) is hose-like, in which the reinforcing threads (1) run in a continuous spiral round the knitted fabric (5).

11. A knitted hose-like thread structure in accordance with claim 10, characterized in that there is a narrow spiral strip (6) without reinforcing thread (1) between the spirally circulating reinforcing threads (1), by means of which the hose-like knitted thread (5) can be cut open to form a ribbon.

12. A thread structure in accordance with claim 9, characterized in that the reinforcing threads, have been coiled, so that the thread structure is elastic also in the direction of the threads.

* * * * *